United States Patent [19]

Kolnes et al.

[11] 4,148,470

[45] Apr. 10, 1979

[54] WORKPIECE PALLET WITH DISTORTION FREE CLAMPING MEANS

[75] Inventors: Kenneth O. Kolnes; Wynsel J. Johnson, both of Rockford, Ill.

[73] Assignee: Greenlee Bros. & Co., Rockford, Ill.

[21] Appl. No.: 832,764

[22] Filed: Sep. 12, 1977

Related U.S. Application Data

[62] Division of Ser. No. 652,257, Jan. 26, 1976, abandoned.

[51] Int. Cl.[2] ..... B25B 1/04

[52] U.S. Cl. ..... 269/101; 269/239

[58] Field of Search ..... 269/91-95, 269/101, 239

[56] References Cited

U.S. PATENT DOCUMENTS

| | | | |
|---|---|---|---|
| 2,727,544 | 12/1955 | MacArthur | 269/94 X |
| 3,194,548 | 7/1965 | Zwick | 269/239 X |
| 3,712,606 | 1/1973 | Cole | 269/239 X |

*Primary Examiner*—Robert C. Watson

*Attorney, Agent, or Firm*—James H. Bower; Mitchell J. Hill

[57] ABSTRACT

A distortion free workpiece clamping means for clamping a workpiece on a pallet for use in a transfer machine. An elongated support bar is operatively attached to the pallet, and an elongated clamp bar is operatively attached to the support bar by a clamp screw means. The clamp bar has a clamp nose on one end thereof for clamping engagement with a workpiece on the pallet, and the other end of the clamp bar is supported by fulcrum means carried by the support bar.

1 Claim, 9 Drawing Figures

WORKPIECE PALLET WITH DISTORTION FREE CLAMPING MEANS

This is a division of application Ser. No. 652,257, filed Jan. 26, 1976 now abandoned.

SUMMARY OF THE INVENTION

This invention relates generally to the machining art, and more particularly, to a novel distortion free workpiece clamping means on a workpiece pallet for use in a transfer machine.

It is necessary when machining a workpiece having an irregular shape, or a workpiece which is not rigid in structure, to clamp the workpiece on a pallet or carrier fixture for moving the workpiece between work stations in an automatic machining apparatus or transfer machine. Heretofore, a problem encountered in clamping a workpiece on a pallet has been that the clamping structure employed would distort the pallet frame due to the clamping stresses exerted thereon by the clamping means. Workpiece pallets of this type have precise skid rails on the bottom side thereof for riding or sliding movement on the ground rails or ways between work stations in the transfer machine. The aforementioned clamping stresses have been found to not only distort the pallet but also distort the skid rails on the lower side of the pallet so that they do not lie flat. Accordingly, when the pallet is transferred, cutting chips build up underneath the pallet which causes the pallet to rise up and change the elevation of the workpiece relative to the desired height or level that the workpiece should assume at the different work stations in the transfer machine. In some cases, such clamping pressure would make the skid rails curl up so that the clamps at a work station for clamping the pallets at the station would pull the skid rails down and thus change the height or elevation of the workpiece. Another problem caused by such distortion of the pallet frame is that chips or bits of metal fall between the pallet skid rails and the ground rails and weld themselves to the pallet skid rails and create a rough rail so as to produce scoring on the rail surfaces and cause distortion and rough surface on the rails. A disadvantage of the prior art clamping means is that the torque which may be employed for securing such clamping means in a clamped position is restricted to prevent distortion of the pallet.

In view of the foregoing, it is an important object of this invention to provide a distortion free clamping means for clamping workpieces to a transfer machine pallet to overcome the aforementioned disadvantages and problems of the prior art workpiece pallet clamping means.

It is another object of the present invention to provide a novel and improved distortion free workpiece clamping means for use with a workpiece pallet, which includes an elongated support bar, means for attaching said support bar to a pallet, an elongated clamp bar having a clamp nose on one end thereof for engagement with a workpiece on the pallet to clamp the workpiece to the pallet, fulcrum means supported by said support bar and engaged with the other end of said elongated clamp bar, and clamp screw means interconnecting said elongated clamp bar with said support bar at a point between said clamp nose and fulcrum means. A spring means is mounted between the support bar and the clamp bar for biasing the clamp bar to an unclamped position when the clamp screw means is operated to relieve clamping pressure on a workpiece. In some embodiments the support bar is loosely secured to the pallet.

It is a further object of the present invention to provide a novel and improved distortion free workpiece clamping means for use with a workpiece pallet, and which is not restricted to a predetermined torque for operating the clamping means.

Other features and advantages of this invention will be apparent from the following detailed description, appended claims, and the accompanying drawings.

DETAILED DESCRIPTION OF THE PREFERRED EMBODIMENTS

Figure 1:
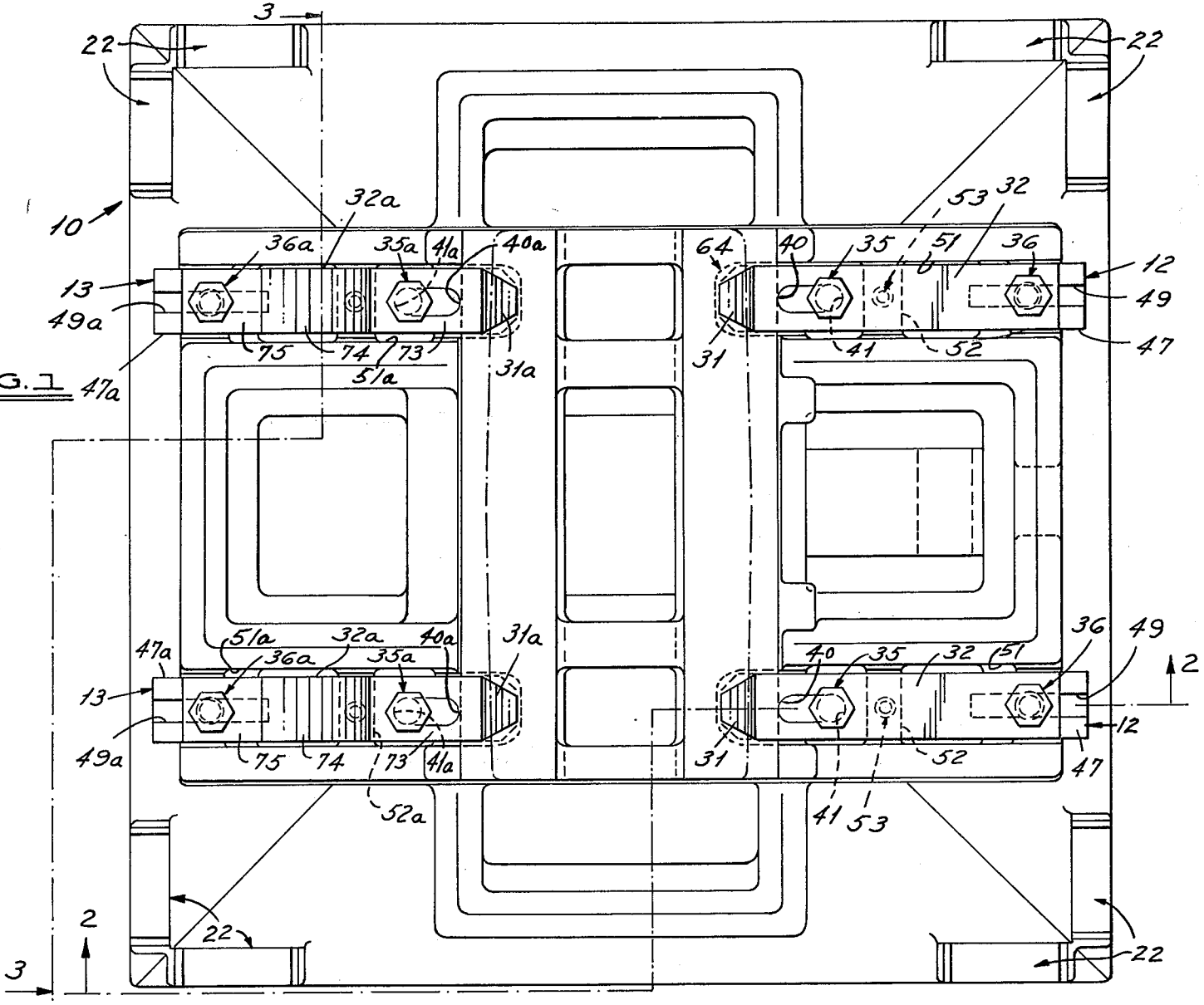
FIG. 1 is a top plan view of a workpiece pallet provided with a first embodiment of a distortion free clamping means made in accordance with the principles of the present invention.
Figure 2:
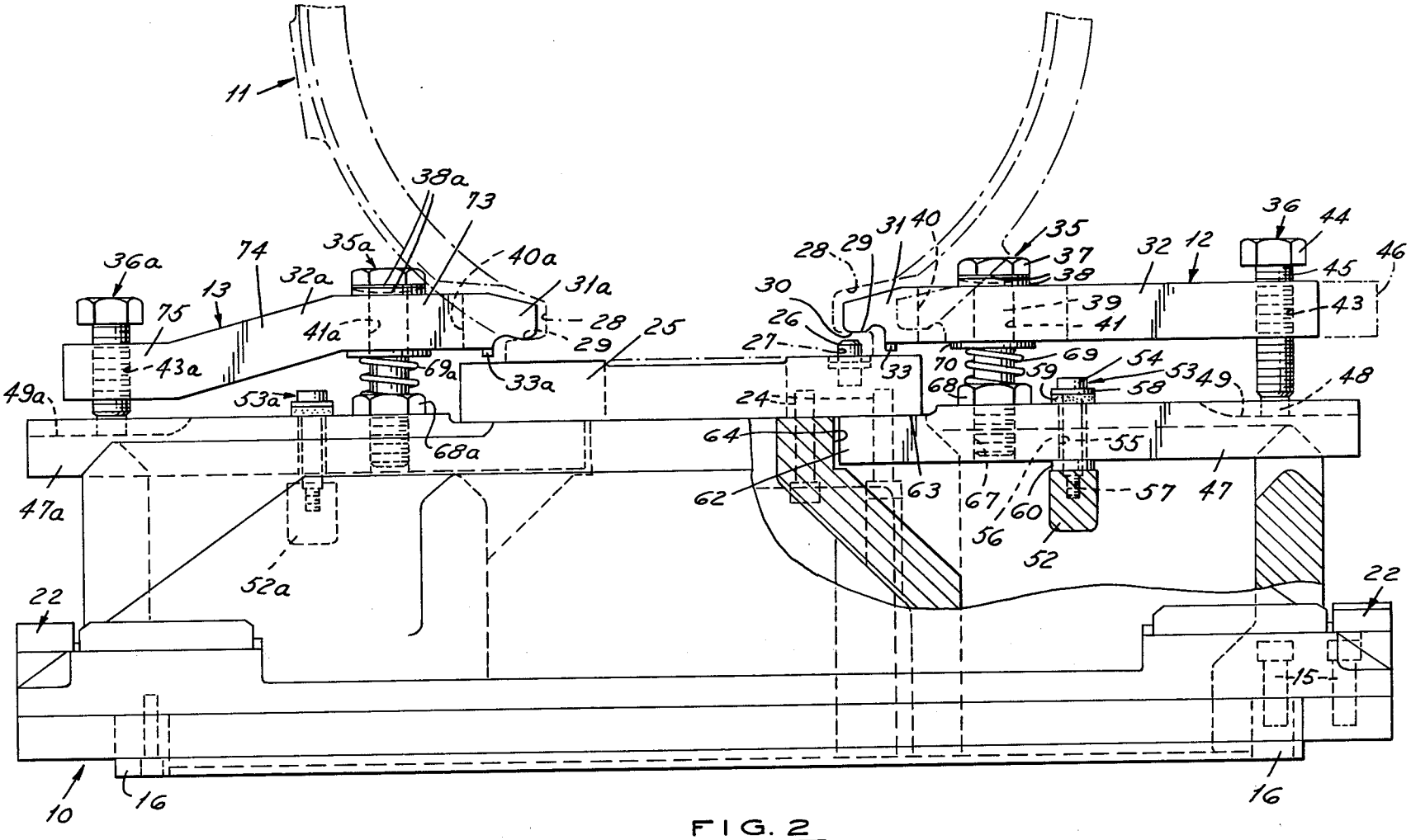
FIG. 2 is a front elevational view, with parts in section and parts broken away, of the pallet and the clamping structure shown in FIG. 1, taken along the line 2—2 of FIG. 1, and looking in the direction of the arrows.

Referring now to the drawings, and more particularly, to FIG. 1, the numeral 10 generally designates a pallet or a carrier fixture on which is operatively mounted a workpiece, generally indicated by the numeral 11 and shown in fragment in FIG. 2. The illustrated workpiece is an automatic transmission case or a housing. It will be understood that other types of workpieces may be carried on the pallet 10. As best seen in FIG. 1, a pair of distortion free clamping means, or apparatuses, each generally indicated by the numeral 12, are operatively mounted on one side of the pallet 10, and a similar pair of such clamping means, each generally indicated by the numeral 13, are operatively mounted on the other side of the pallet 10. The pallet 10 may be of any conventional type for moving a workpiece 11 along precision ground rails or ways of an automatic machining apparatus or transfer machine which has a plurality of work stations, and wherein the pallet 10 is moved between work stations and clamped in place at each work station to permit one or more machining operations to be carried out at each work station on the workpiece 11 carried on the pallet 10.

Figure 3:
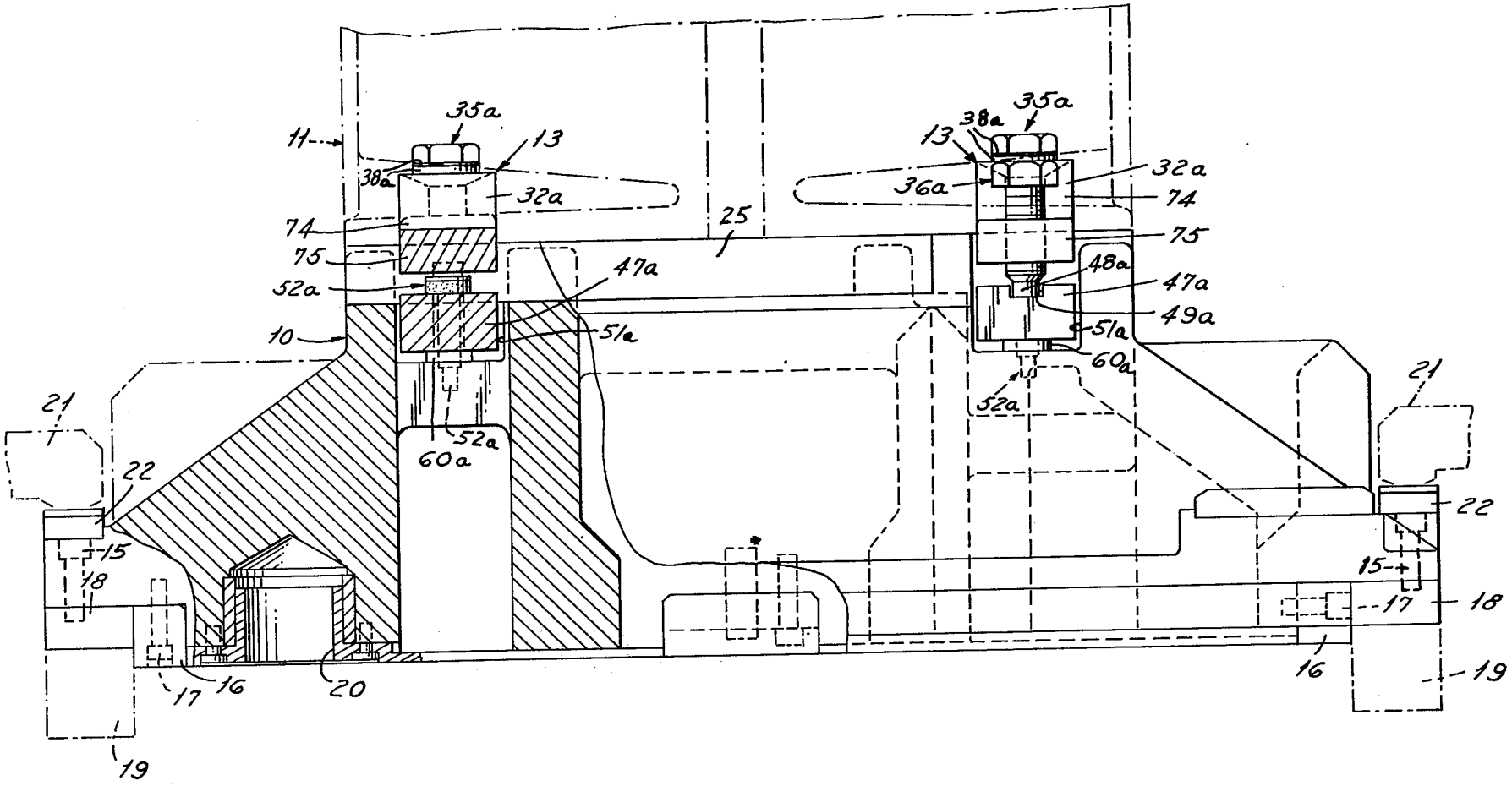
FIG. 3 is a left side elevational view, with parts broken away and parts in section, of the structure illustrated in FIG. 1, taken along the line 3—3 thereof, and looking in the direction of the arrows.

As shown in FIG. 3, the pallet 10 is provided with a longitudinally extended skid rail 18 along each side thereof. Each of the skid rails 18 is secured to the pallet frame structure by any suitable means, as by suitable machine screws 15. The pallet skid rails 18 are slidably mounted on spaced apart ground rails or ways 19 in a transfer machine to permit the pallet to be moved along the ground rails 19 from work station to work station. A suitable guide rail 16 is fixedly mounted on the lower side of the pallet 10, by suitable machine screws 17, along each side thereof, for slidable guiding contact with the inner vertical faces of the ground rails 19. As shown in FIG. 3, the pallet 10 is provided with a suitable dowel bushing 20 for the reception of a master dowel at each of the transfer machine work stations to precisely position the pallet 10 at each work station. The numerals 21 indicate conventional work station clamps which are adapted to operatively engage the clamp pads 22 on the pallet 10 for clamping the pallet 10 in an operative position at a work station.

As shown in FIG. 2, the workpiece 11 is seated on a work table or work support member 25 which is secured on the upper side of the pallet 10 by any suitable means, as by machine screws 24. The workpiece 11 is located in a desired position on the work support member 25 by suitable locating dowel pins, as for example, the dowel pin 26 which extends upwardly into a dowel hole 27 formed in the bottom surface of the workpiece 11. The workpiece 11 has a longitudinal recess 28 formed along the lower end of each side thereof. The recess 28 forms an outwardly extended clamp flange 29 along each of the lower sides of the workpiece 11 for clamping engagement with the lower side 30 of the clamp arm nose 31. The clamp arm nose 31 is integrally formed on the front end of an elongated upper clamp arm or bar 32 which forms a part of the clamping means 12. A clamp empty stop 33 is formed on the lower side of the clamp nose 31. When a workpiece is not on the pallet, the clamp arm 32 lays down with the stop 33 seated on the work table 25. The structure of each of the clamping means 12 will first be described.

As shown in FIGS. 1 and 2, each of the clamping means 12 includes a pair of screws, generally designated by the numerals 35 and 36. The fulcrum screw 35 comprises a conventional machine screw which has a head 37 and an integral threaded body 39. The fulcrum screw body 39 extends downwardly through an elongated slot formed through the upper clamp bar 32 at right angles to the longitudinal axis thereof. As best seen in FIG. 1, the last mentioned elongated slot extends longitudinally through the upper clamp bar 32, and the forward end thereof is indicated by the numeral 40 and the rear end thereof is indicated by the numeral 41. A set of spherical washers 38 are positioned between the clamp screw head 37 and the upper side of the upper clamp arm 32. The clamp screw 36 comprises a conventional machine screw which has a head 44 and an integral threaded body 45. The clamp screw body 45 is threadably mounted in a threaded hole 43 which extends downward through the upper clamp bar 32 at right angles to the longitudinal axis of the upper clamp bar 32. As shown in FIG. 2, the lower end 48 of the clamp screw 36 is reduced in diameter and it is unthreaded and cylindrical in shape. The clamp screw lower end 48 is slidably mounted in a longitudinally extended milled slot 49 which is formed in the upper surface of the lower clamp arm or bar 47. It will be seen that the upper clamp bar 32 is shown in solid lines in a workpiece clamping position, and it is shown in broken lines in a manually retracted or unclamped position as indicated by the numeral 46.

As shown in FIG. 1, the lower clamp bar 47 is seated on a milled slot 51 formed parallel to the longitudinal axis of the pallet. The lower clamp bar 47 is supported on a pallet frame support beam 52 (FIG. 2) which is disposed transverse to the longitudinal axis of the lower clamp bar 47. The lower clamp bar 47 is secured to the support beam 52 by a shoulder bolt, generally indicated by the numeral 53. The bolt 53 includes a head 54 and an elongated body 55 which extends through the bore 56 which is formed vertically through the lower clamp bar 47. The lower end of the bolt body 55 is threadably mounted in a threaded bore 57 formed in the upper side of the support beam 52. The bolt head 54 is spaced from the upper side of the lower clamp bar 47 by a metal washer 58, and a rubber washer 59 which has its lower face seated on the upper side of the clamp bar 47. A rubber washer 60 is mounted around the bolt body 55 and positioned between the lower side of the lower clamp bar 47 and the upper face of the support beam 52.

The lower clamp bar 47 includes a reduced in size nose 62, on the front end thereof, which has a flat top surface that abuts the under flat surface of a flange formed by a pocket 64. The lower end of the clamp screw body 39 is threadably mounted in a threaded bore 67 that is formed perpendicular to the longitudinal axis of the lower clamp bar 47. A lock nut 68 secures the screw clamp body 39 in an adjusted position in the lower clamp bar 47. A compression spring 69 is mounted about the clamp screw body 39, with its lower end abutting the upper side of the lock nut 68. A suitable metal washer 70 is mounted about the clamp screw body 39 and it is seated against the lower side of the upper clamp bar 32. The upper end of the spring 69 abuts the washer 70.

As shown in FIG. 1, the illustrative embodiment includes two of the clamping means 12 on one side of the workpiece 11. However, it will be understood that more than two, or less than two, of the clamping means 12 may be used, as required. As shown in FIG. 2, the clamping means 13 is constructed the same as the clamping means 12, and the corresponding parts have been marked with the same reference numerals, followed by the small letter "a". The only difference between the clamping means 12 and 13 is that the upper clamping bar **32*a* is formed with a front end portion 73 that carries the nose 31*a*, and a rear end portion 75 which is parallel to the front end portion 73 and offset downwardly therefrom. A central, upwardly angled portion 74 integrally connects the front end of the rear end portion 75 and rear end of the front end portion 73. As shown in FIG. 1, the illustrative embodiment includes two of the clamping means 13, and it will be understood that more or less of the clamping means 13** may be used, as required.

Each of the clamping means 12 and 13 is loosely held by the shoulder bolts 53 and **53*a*, respectively, and the upper and lower clamping bars 32 and 47 function as a pair of pincher members. Clamping is effected by using the mechanical advantage of a screw. The clamping arms, or clamp bars 32 and 47 function to hold the workpiece 11 on the pallet 10 without distorting the pallet. The clamp screws 35 and 35***a* function as fulcrums for supporting the outer ends of the upper clamp bars 32 and 32*a* during a clamping operation.

In use, the clamp screws 36 and 36*a* are threaded so as to move them upwardly relative to the upper clamp bars 32 and 32*a* to permit said clamp bars to be moved longitudinally outward so that the front noses 31 and 31*a* will be clear of a workpiece 11 when it is positioned on the work table 25. The clamp screws 35 and 35*a* are adjusted to a desired position, and then the lock nuts 68 and 68*a* are secured in position. After the workpiece 11 has been put in position on the work table 25, the upper clamp bars 32 and 32*a* are manually moved longitudinally inward toward the workpiece 11 so as to have the clamp bar noses 31 and 31*a* slidably engage the workpiece flanges 29. Clamping pressures are exerted by threading the clamp screws 36 and 36*a* downwardly so as to pivot the clamp bar outer ends upwardly and the noses 31 and 31*a* downwardly into clamping engagement with the workpiece flanges 29 for holding them in a clamped position on the upper surface of the work table 25. The inner clamp screws 35 and 35*a* are initially adjusted so that when the upper clamp bars 31 and 32*a* are in their fully clamped positions, they are preferably in parallel position with the lower clamp bars or support bars 47, so as to provide a clamping force which is perpendicular to the work table 25. The clamping action thus is all perpendicular to the work table 25 without any lost clamping components directed in other directions which may have a tendency to exert a bending or warping force on the pallet, which would in turn be transferred into the pallet skid rails 18.

Figure 4:
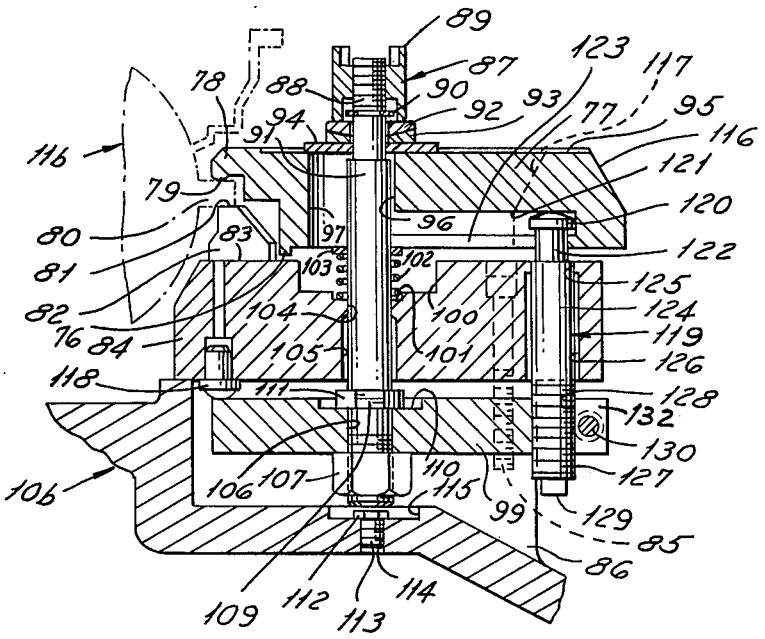
FIG. 4 is an elevation section view of a second embodiment of a distortion free clamping means made in accordance with the principles of the present invention, and showing a fragmentary portion of a workpiece and a pallet.
Figure 5:
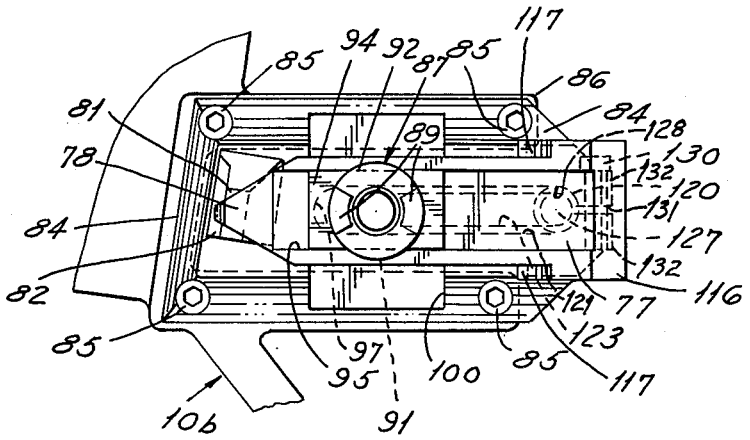
FIG. 5 is a fragmentary top view of the structure illustrated in FIG. 4.

FIGS. 4 and 5 illustrate a cam operated embodiment of a clamping means for use with a workpiece pallet. The numeral 10*b* generally designates a fragmentary portion of a pallet and the numeral 11*b* generally designates a fragmentary portion of a workpiece carried on the pallet 10*b*.

The clamping means illustrated in FIGS. 4 and 5 includes an upper clamping arm or bar 77 which is provided on the inner end thereof with a reduced in size nose portion 78. The clamp bar nose 78 has a workpiece engaging surface 79 on the lower side thereof which is adapted to engage a portion of the workpiece, such as a flange 80, and clamp it to the upper flat surface 81 of a workpiece support or pedestal 82. The workpiece support or pedestal 82 is fixed by any suitable means on the upper flat face 83 of a work table 84. The work table 84 is fixedly secured to the pallet frame structure 86 by a plurality of suitable machine screws 85. A clamp empty stop 76 is formed on the lower side of the clamp bar nose 78. When a workpiece 11*b* is not on the pallet 10*b*, the clamping arm 77 is laid down with its stop 76 seated on the face 83 of the work table 84.

A first clamp screw, as indicated by the numeral 88, has a nut 87 threaded on its upper end, on which is formed a pair of projections 89 for engagement with a power tool drive means. The clamp screw 88 has an elongated body 91 which extends downwardly through suitable holes formed through a pair of spherical washers 92 and 93 which form a set and are seated on a cover plate 94 that is slidably mounted in a longitudinally extended recess 95 formed on the upper face of the clamp bar 77. Mounting washers 92 and 93 are circular, and the upper face of the washer 93 is concave and the lower face of the washer 92 is convex, to permit rocking movement of the screw body 91. A suitable snap ring 90 is mounted on the upper end of the clamp screw 88, and it functions to hold the clamp bar 77 at a constant opening level regardless of how far the nut 87 is unscrewed. As shown in FIG. 4, the screw body 91 extends downwardly through a slot that passes vertically through the upper clamp bar 77 and which is extended longitudinally thereof. The numeral 96 indicates the rear end of the last mentioned slot and the numeral 97 indicates the front end of said slot. The cover plate 94 keeps chips out of the last mentioned slot.

The numeral 99 designates a lower clamp arm or bar to which the first clamp screw 88 is attached. The clamp screw body 91 extends downwardly from the upper clamp bar 77 and through a transverse recess 100, a circular recess 101 and the bores 104 and 105 in the pallet work table 84. A compression spring 102 is mounted around the bolt body 91 and its lower end is seated in the circular recess 101. The upper end of the compression spring 102 is seated against a washer 103 which is seated on the lower side of the upper clamp bar 77. The lower end of the bolt 88 extends downwardly through a recess 110 and a bore 106 formed through the lower clamp bar 99. A circular flange 111 with flats 109 is formed integrally on the lower end of the screw body 91 and it is seated in a slotted recess 110 to prevent rotation. The extreme lower end of the screw body 91 has operatively mounted thereon a suitable lock nut 107. It will be seen that the lower clamp bar 99 is secured to the bolt body 91 by action of the integral flattened flange 111 and the lock nut 107. A stop screw or abutment screw, having a body 113 and a head 112, is threadably mounted in a threaded bore 114 which communicates with a recess 115 in the frame of the pallet 10*b*. The abutment screw head 112 is seated in the recess 115, and supports bolt 91 and therefore clamp bar 77 when it is unclamped. This makes for easy camming action to move clamp bar 77.

A fulcrum screw, generally indicated by the numeral 119, provides a fulcrum or support for the outer end of the upper clamp arm 77. The fulcrum screw 119 includes a rounded head 120 and an integral body, including an upper end portion 122. The fulcrum screw head 120 is slidably mounted in a longitudinally extended slot 121 which communicates at its inner end with the slot through which the screw body 91 extends. The fulcrum screw body upper end portion 122 is slidably mounted in a longitudinally extended slot 123 which communicates with the slot 121 and the slot through which the screw body 91 extends. The longitudinally extended slots 121 and 123 form a T-shaped slot for slidably retaining the fulcrum screw 119 in the lower side of the upper clamp bar 77.

The fulcrum screw 119 further includes a central, elongated and non-threaded portion 124 which is slidably mounted through a bore 125 and a communicating, enlarge diameter bore 126. The bores 125 and 126 are both formed through the work table 84 of the pallet 10*b*. The bore 125 is formed to a diameter to provide sliding contact with the fulcrum screw body portion 124, while the diameter of the bore 126 is enlarged to provide a space between the fulcrum screw body portion 124 and the wall surface of the bore 126. The lower end 127 of the body of the fulcrum screw 119 is threaded, and it is threadably mounted in a threaded bore 128 formed through the lower clamp bar 99 and which is perpendicular to the longitudinal axis of the lower clamp bar 99.

As shown in FIG. 4, the lower end 127 of the fulcrum screw 119 is formed with a wrench end 129 to permit the adjustment of the fulcrum screw portion 127 in the bore 128. As best seen in FIG. 5, the outer end of the lower clamp bar 99 is provided with a slot 131 which extends inwardly into communication with the bore 128 to provide a pair of spaced apart or bifurcated bar end portions 132. The bifurcated end portions 132 are adapted to be forced together by a suitable lock screw 130 for locking the threaded lower end 127 of the fulcrum screw 119 in an adjusted position in the bore 128. As shown in FIG. 4, the inner end of the lower clamp bar 99 abuts, on its upper side, with a rounded head, button-type abutment 118 which has an elongated body that is press-fitted into a suitable hole in the lower side of the work table 84.

In use, the clamping means illustrated in FIGS. 4 and 5 functions in the same manner as the first described embodiment of FIGS. 1 through 3 in that the outer screw 119 functions as a fulcrum during the clamping action. In the embodiment of FIGS. 4 and 5, the final clamping action is created by attaching a suitable power tool to the socket head 89 and tightening the nut 87 on the clamp screw 88. When the nut 87 is unloosened, the spring 102 functions to pivot the front end of the upper clamp bar 77 clockwise upwardly to an unclamped position, in the same manner as the spring 69 in the first described embodiment of FIGS. 1, 2 and 3. As shown in FIGS. 4 and 5, the clamp bar 77 is provided on its rear end with a downwardly and outwardly sloping cam surface 116 for operative engagement by a suitable vertical cam means for automatically camming the clamp bar 77 inwardly. As best seen in FIG. 5, an inwardly sloping surface 117 is formed on each side of the clamp bar 77 for operative engagement by a suitable vertical cam means for camming the clamp bar 77 outward automatically.

When the nut 87 is rotated, so as to bring the nose portion 78 of the upper clamp bar 77 downwardly into clamping engagement with the workpiece flange 80, the lower clamp bar 99 is also moved upwardly and held with its inner end fixed against the abutment 118. In the clamped position, as shown in FIG. 4, the lower end of the clamp screw body 91 is spaced from the abutment screw head 112 by a clearance or gap, as for example 0.03". When the clamping means of FIG. 4 is in the unclamped position, the lower end of the clamp screw body 91 abuts the screw head 112. It will be seen that the clamp means of FIGS. 4 and 5 is also loosely held on the pallet 10*b*. It will also be seen that the clamping means of FIGS. 4 and 5 also provides a clamping means wherein the upper clamp bar 77 is parallel to the lower clamp bar 99 when the clamping means is in the clamping position, and that the nose portion 78 exerts a downward vertical or perpendicular pressure in alignment with the pressure exerted perpendicular upwardly by the lower clamp bar 99 through the stop button 118, to provide a pincher action in the same manner as in the first embodiment of FIGS. 1, 2 and 3. In the first embodiment, the pincher type action provides a perpendicular clamping force down through the upper clamping means nose 31 to the inner end 62 of the lower clamp arm 47. The screw 119 in the embodiment of FIGS. 4 and 5 functions as a fulcrum member for the upper clamp bar 77.

Figure 6:
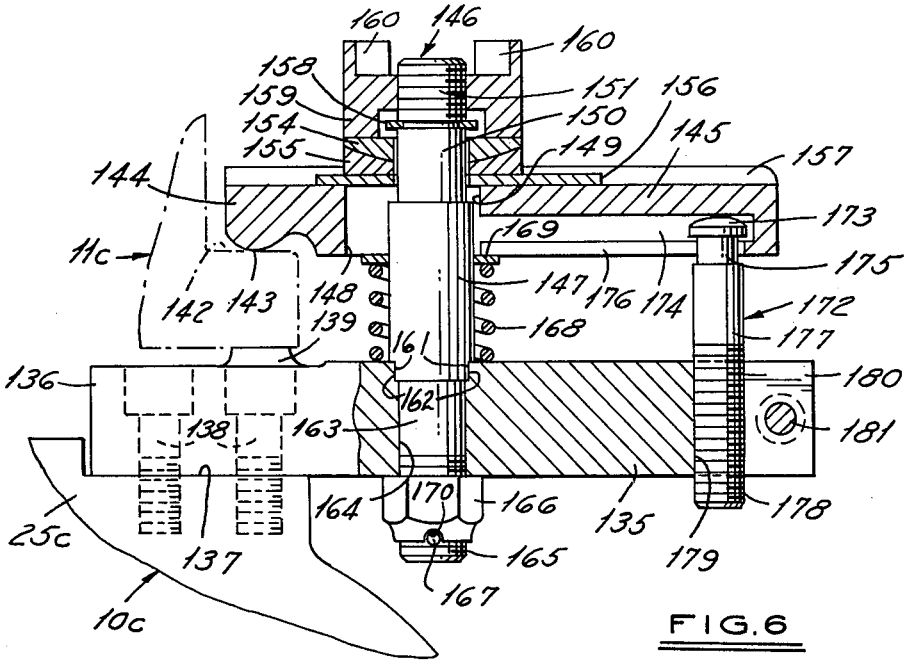
FIG. 6 is a side elevation view, partly in section, of a third embodiment of a vertically mounted distortion free clamping means made in accordance with the principles of the present invention, and showing a fragmentary portion of a workpiece and pallet.

FIG. 6 illustrates a third embodiment of the invention wherein the pallet is shown in fragment by the numeral 10*c*, and the workpiece is shown in fragment by the numeral 11*c*. The embodiment of FIG. 6 is adapted for vertical mounting. The third embodiment of FIG. 6 includes a lower clamp arm or bar 135 which has an inner end 136 that is seated on a vertical shoulder 137 formed on the pallet 10*c*. The inner end 136 of the lower clamp or support arm 135 is fixed on the vertical shoulder 137 by any suitable means, as by a pair of suitable machine screws 138. The lower clamp arm 135 is provided on the outer face of the inner end 136 with a raised, hard steel workpiece support member 139 on which a flange portion of the workpiece 11*c* is seated or located. The outer face 142 of a workpiece flange is engaged by the lower face 143 on the inner end 144 of the outer clamp arm or bar 145. The numeral 146 generally designates a clamp screw which has a central unthreaded body portion 147 that is slidably mounted through an elongated slot that passes transversely through the clamp bar 145 and which is extended longitudinally thereof. The numeral 148 indicates the front end of the last mentioned slot, and the numeral 149 indicates the rear end of said slot.

The clamp screw 146 includes an outer unthreaded body portion 150 which is integral with the body portion 147 and made to a smaller diameter. The outer end 151 of the clamp screw 146 is threaded. The unthreaded body portion 150 of the clamp screw 146 is slidably mounted through a set of circular, spherical washers 154 and 155, and a cover plate 156 which is slidably mounted in a longitudinal extended recess 157 formed in the outer face of the clamp bar 145. The cover plate 156 keeps dirt out of the slot through which the clamp screw body portion 147 extends through the clamp bar 145, and the ends of which are indicated by the numerals 148 and 149. A suitable snap ring 158 is mounted on the upper end of the clamp screw 146. A suitable nut 159 is threadably mounted on the clamp screw threaded outer end 151, and it is provided with integral power tool drive socket members 160 to permit tightening of the nut 159 by a power tool. The snap ring 158 functions to hold the clamp bar 145 at a constant opening level regardless of how far the nut 159 is unscrewed.

The inner end body portion 163 of the clamp screw 146 is reduced in diameter compared to the central body portion 147, and it is unthreaded and slidably mounted through a transverse bore 164 formed through the inner support bar 135. The upper end portion 161 of the bore 164 is enlarged and it is provided with flat portions 161 for the reception of flat portions 162 on the lower inner end of the clamp screw central body portion 147 to prevent rotation of the clamp screw 146. The extreme inner end 165 of the clamp screw 146 is threaded, and it has operatively mounted thereon a suitable lock nut 166 which abuts the outer face of the support bar 135. A suitable retainer pin 167 is mounted through the clamp screw threaded end 165, and it has its outer end projected therebeyond and seated in suitable recesses 170 in the outer end of the nut 166. A compression spring 168 is mounted around the clamp screw central body portion 147 and its lower end is seated against the outer face of the support bar 135. The other end of the compression spring 168 is seated against a suitable washer 169 which is seated on the inner side of the outer clamp bar 145.

A fulcrum screw, generally indicated by the numeral 172, provides a fulcrum or support for the outer end of the outer clamp arm 145. The fulcrum screw 172 includes a rounded head 173, and an integral main body 177, including an outer reduced diameter end portion 175. The fulcrum screw head 173 is slidably mounted in a longitudinally extended slot 174 which communicates at its inner end with the slot through which the screw body 147 extends. The fulcrum screw body outer end portion 175 is slidably mounted in a longitudinally extended slot 176 which communicates with the slot 174 and the slot through which the screw body 147 extends. The longitudinally extended slots 174 and 176 form a T-shaped slot for slidably retaining the fulcrum screw head 173 in the inner side of the outer clamp bar 145.

The fulcrum screw 172 further includes an integral inner threaded end portion 178 which is threadably mounted through a threaded bore 179 formed through the outer end of the support bar 135. The bore 179 is perpendicular to the longitudinal axis of the support bar 135.

The outer end of the support bar 135 is bifurcated in the same manner as the support bar 99 of the embodiment of FIG. 4. The numeral 180 indicates one of the bifurcated ends, and the numeral 181 designates a suitable lock screw for forcing the bifurcated ends 180 together to lock the fulcrum screw threaded end 178 in an adjusted position in the threaded bore 179.

In use, the clamping means illustrated in FIG. 6 functions in the same manner as the second described embodiment of FIGS. 4 and 5, in that the outer screw 172 functions as a fulcrum during a clamping action. The workpiece **11*c* is located on the hard steel locating member 139 on the support bar 135. The embodiment of FIG. 6 is adapted for use in a vertical mounting. The final clamping action is created by attaching a suitable power tool to the socket head members 160 and tightening the nut 159 on the clamp screw 146. When the nut 159 is unloosened, the spring 168 functions to pivot the front end or inner end of the outer clamp bar 145 clockwise, as viewed in FIG. 6, in the same manner as the spring 102 functions in the second described embodiment of FIGS. 4 and 5. The outer clamping bar 145 is adapted to be moved to the right, or outwardly when it is in the unloosened position to clear the workpiece 11*c* to permit another workpiece to be mounted on the locating member 139. The outer clamping bar 145** is adapted to be manually moved inwardly and outwardly between the inoperative position and the operative clamping position.

Figure 7:
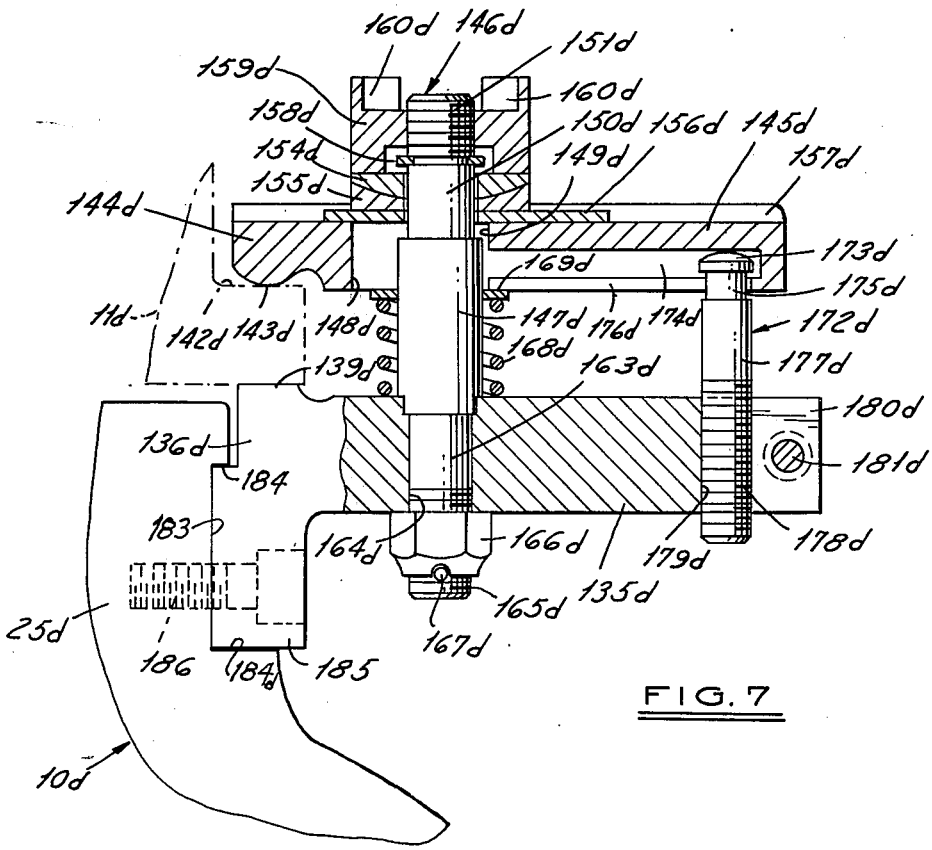
FIG. 7 is a plan view, partly in section, of a fourth embodiment of a horizontally mounted distortion free clamping means made in accordance with the principles of the present invention, and showing a fragmentary portion of a workpiece and pallet.

FIG. 7 illustrates a fourth embodiment of the invention wherein the pallet **10*d* is shown in fragment, and the workpiece 11*d* is shown in fragment. The workpiece 11*d* includes a flange which has its lower face seated on the horizontal face of a raised locating abutment 139*d* formed on the inner end 136*d* of a support bar 135*d*. The embodiment of FIG. 7 is adapted for horizontal mounting, and the parts thereof which are the same as the embodiment of FIG. 6 have been marked with the same reference numerals followed by the small letter "d". A support bar 135*d* is provided with a depending, axially offset support arm 185 which is integrally formed on the inner end 136*d* of the support bar 135*d*, and it is secured by a suitable machine screw 186 to a vertical surface 183 on the pallet 10*d*, and located into a keyway formed by the downward facing shoulder 184 and the upward facing shoulder 184*d*. In use, the embodiment of FIG. 7 is mounted horizontally, and it functions in the same manner as the embodiment of FIG. 6**.

Figure 8:
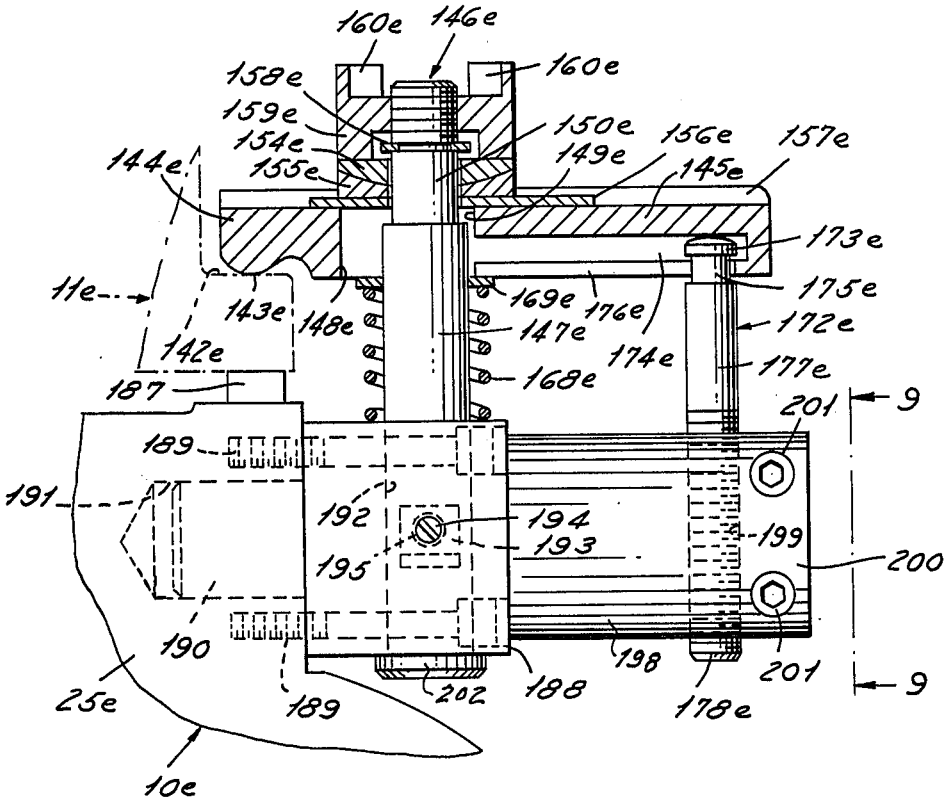
FIG. 8 is a plan view, partly in section, of a fifth embodiment of a horizontally mounted distortion free clamping means made in accordance with the principles of the present invention, and showing a fragmentary portion of a workpiece and pallet.
Figure 9:
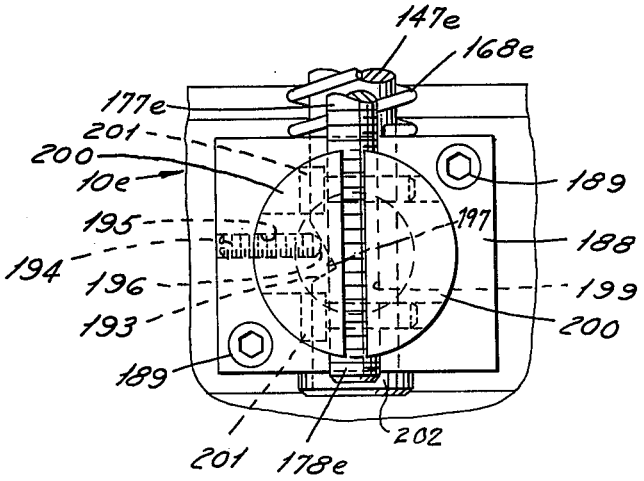
FIG. 9 is a fragmentary, side view of the structure illustrated in FIG. 8, taken along the line 9—9 thereof, and looking in the direction of the arrows.

FIGS. 8 and 9 illustrate a fifth embodiment of the invention, wherein a pallet **10*e* is shown in fragment, and a workpiece 11*e* is shown in fragment. The embodiment of FIGS. 8 and 9 is adapted for use on a horizontal mounting. The parts of the embodiment of FIGS. 8 and 9 which are the same as parts in the embodiments of FIGS. 6 and 7** have been marked with the same reference numerals followed by the small letter "e".

The numeral 187 designates a hard steel locating member which is formed on the pallet **10*e* for seating engagement with a flange on the workpiece 11*e* for locating the workpiece. In the embodiment of FIGS. 8 and 9, the support bar is constructed different than the corresponding structure in the embodiments of FIGS. 6 and 7. A support body 188, in the form of a rectangular block, has its outer face seated against a vertical surface on the pallet 10*e*, and it is secured to the pallet 10*e* by a pair of suitable machine screws 189. A locating shaft 190 is integrally formed on the support body 188 and it is slidably mounted in a bore 191 which extends inwardly into the pallet 10*e* from the vertical surface on which the support body 188 is seated. The lower end of the clamp screw 146*e* is unthreaded, and it is slidably mounted through an unthreaded bore 192 in the support body 188. The lower end of the clamp screw 146*e* is provided with an enlarged head 202 which is seated against the lower side of the mounting body 188**.

As best seen in FIG. 9, the clamp screw body **147*e*, which is positioned within the bore 192, is provided on one side thereof with a recess which has an inward and downward sloping flat surface 197 and an inward and upward sloping flat surface 193. A lock screw 194 is threadably mounted in a bore 195 formed in the support body 188, and the inner end 196 thereof extends into the last mentioned recess in the clamp screw body 147*e* and abuts the surface 197 to retain the clamp screw 146*e* against rotation in the support body 188. The last described structure also permits longitudinal adjustment of the clamp screw 146*e* in the block 188**.

As shown in FIG. 8, the support arm or bar structure of the embodiment of FIGS. 8 and 9 comprises the support body 188 and an integral, outwardly extended support bar 198 which is formed on a longitudinal axis parallel to the upper clamp bar **145*e*. The lower threaded end 178*e* of the fulcrum screw 172*e* is threadably mounted in a bore 199 which is formed perpendicular to the longitudinal axis of the support bar 198. The outer end of the support bar 198 is bifurcated to provide two bifurcated ends 200, as shown in FIG. 9. The bifurcated ends 200 are adapted to be forced together by a pair of suitable machine screws 201 for clamping the threaded end 178*e* of the fulcrum screw 172*e* in an adjusted position in the support bar 198**.

In use, the embodiment of FIGS. 8 and 9 is disposed in a horizontal mounting position, and it functions in the same manner as described hereinbefore for the embodiments of FIGS. 6 and 7.

It will be seen from the foregoing description of the illustrated embodiments, that the clamping means of the present invention provides a clamping arrangement whereby a workpiece may be clamped on a pallet without distorting the pallet frame due to clamping stresses exerted thereon by the clamping means. The clamping means of the present invention are adapted to secure workpieces on a pallet without distorting the skid rails on the bottom side of the pallet, whereby precise and accurate positioning of a workpiece on the pallet may be obtained at a work station in a transfer machine. The prior art clamping means have a disadvantage in that they are limited as to the torque that can be employed in securing the clamping means in place to avoid distortion of the pallet, and because of such torque limitations it has been found that the prior art clamping means become loose during use thereof due to vibration as the pallets pass through a transfer machine. The clamping means of the present invention are not limited to low torque values and, accordingly, overcome the last described disadvantage of the prior art clamping means. In all of the aforedescribed embodiments, the lower clamp bar may also be termed an elongated support bar.

While it will be apparent that the preferred embodiments of the invention herein disclosed are well calculated to fulfill the objects above stated, it will be appreciated that the invention is susceptible to modification, variation and change.

What is claimed is:

1. In a clamping means for clamping workpieces on a pallet for use in a transfer machine, the combination comprising:

(a) an elongated support bar;

(b) means for attaching said support bar to a pallet;

(c) an elongated clamp bar having a clamp nose on one end thereof for engagement with a workpiece on the pallet to clamp the workpiece to the pallet; said elongated clamp bar is provided with a longitudinally extended recess on the lower side thereof and toward said other end thereof;

(d) fulcrum means supported by said support bar and engaged with the other end of said elongated clamp bar; said fulcrum means comprises:

(1) a clamp screw having a central body portion slidably mounted in a bore formed through the pallet;

(2) a head portion on the upper end thereof slidably mounted in said longitudinal recess in the lower side of said elongated support bar; and (3) a lower end adjustably mounted in the outer end of the elongated support bar;

(e) the outer end of the support bar is bifurcated and includes means for forcing the parts of said bifurcated end together to retain the fulcrum clamp screw in fixed position in the support bar.

* * * * *